US005470175A

United States Patent [19]

Jensen et al.

[11] Patent Number: 5,470,175

[45] Date of Patent: Nov. 28, 1995

[54] APPARATUS AND METHODS FOR EFFICIENT AND PRECISE PLACEMENT OF DISCRETE QUANTITIES OF MATERIALS ADJACENT TO THE APPARATUS

[75] Inventors: Darrell V. Jensen; Carl J. Hobbs; M. Andrew Blight, all of Blackfoot, Id.

[73] Assignee: Spudnik Equipment Company, Blackfoot, Id.

[21] Appl. No.: 245,154

[22] Filed: May 16, 1994

[51] Int. Cl.[6] ..... E01C 19/45

[52] U.S. Cl. ..... 404/72; 404/108; 414/346; 414/353; 414/505; 414/523; 414/528

[58] Field of Search ..... 404/108, 110, 404/72; 414/343, 345, 346, 352, 353, 502, 503, 505, 523, 528, 325, 326; 405/268, 179, 17

[56] References Cited

U.S. PATENT DOCUMENTS

| | | | |
|---|---|---|---|
| 2,381,783 | 8/1945 | Stevenson . | |
| 3,857,335 | 12/1974 | Wagley | 414/503 X |
| 4,157,005 | 6/1979 | Orlando et al. . | |
| 4,310,293 | 1/1982 | Eggleton | 404/98 X |
| 4,583,905 | 4/1986 | Scherr . | |
| 4,795,264 | 1/1989 | Riker | 414/502 X |
| 5,044,867 | 9/1991 | Pettijohn . | |
| 5,100,277 | 3/1992 | Musil . | |
| 5,244,333 | 9/1993 | Byrne . | |

*Primary Examiner*—William P. Neuder
*Attorney, Agent, or Firm*—Workman, Nydegger & Seeley

[57] ABSTRACT

Apparatus and methods are described for efficient and precise placement of discrete quantities of materials adjacent to the apparatus. The apparatus and methods are particularly adapted for being coupled to a dump truck, receiving material contained in the bed of the dump truck into a hopper, metering the material in the hopper by a receiving conveyor and transferring the metered material from the receiving conveyor to the side of the apparatus by a cross conveyor positioned perpendicularly to the receiving conveyor. A telescoping boom conveyor having a material director transfers the metered material from an end of the cross conveyor and places the metered material adjacent to the apparatus. Attached at the other end of the cross conveyor is a material positioning attachment for positioning the precisely placed material into a level grade or a road curb.

57 Claims, 8 Drawing Sheets

APPARATUS AND METHODS FOR EFFICIENT AND PRECISE PLACEMENT OF DISCRETE QUANTITIES OF MATERIALS ADJACENT TO THE APPARATUS

BACKGROUND OF THE INVENTION

1. The Field of the Invention

The invention relates generally to apparatus and methods for efficient and precise placement of discrete quantities of materials adjacent to the apparatus as the apparatus is advanced forward. More particularly, the invention relates to an apparatus and method for the placement of top soil, the filling of gabion baskets, the bedding of water and sewer lines, the placement of aggregates around an under drain and an edge drain, the placement of aggregate as grading for a sidewalk or a curb, the placement of riprap at the edge of a body of water and the placement of aggregate around a water or phone line, the grading of aggregates and the forming of structures such as a curb or a curb and gutter.

2. Background Art

In the construction industry, many projects involve moving large quantities of material and placing portions of the material at a desired location. When the desired location for placing the material has a small area, the material must be portioned or metered into discrete quantities of material and precisely placed. Generally, such construction projects are accomplished by unloading large quantities of material from machinery, such as a dump truck, and then precisely placing discrete quantities of the material by relying on manual labor.

An example of material typically placed in discrete quantities is the aggregate around a drain pipe in an edge drain alongside of a roadway. Large amounts of aggregate are required to fill the length of such edge drains, however, the aggregate must be placed in discrete quantities as most edge drains are shallow and have a narrow opening. Machinery, such as a front end loader can portion the aggregate along the edge drain while laborers place uniform amounts within the edge drain. Similar methods are utilized for placing top soil, gabion basket fill, water and sewer line bedding fill, aggregate around an under drain near a roadway, aggregate for a sidewalk or curb grading, riprap at the edge of a body of water and aggregate around a water or phone line.

Placing discrete quantities of material is also often difficult due to the steepness of the area where the material is to be placed. Filling gabion baskets provides an example of the difficulty frequently encountered in placing material. Gabion baskets, which are chicken wire boxes filled with aggregate, are utilized to line waterways and roadways having steep sides to prevent erosion or rock slides. The steep banks and roadsides necessitating the use of gabion banks are challenging terrains for manually placing the aggregate within the gabion baskets. The gabion baskets can also be mechanically filled by a machine such as a front end loader, however, large quantities of aggregates are wasted due to the inability of such machines to precisely place the aggregate within the gabion box. Additionally, a front end loader cannot uniformly fill gabion boxes necessitating manual finish work.

Additionally, placing discrete quantities of material is often difficult due to obstacles in the area where the material is to be placed. For example, curbs alongside a road obstruct movement when preparing a bed for a sidewalk by placing aggregate at the desired location of the sidewalk. Curbs are also frequently in an uncured state when sidewalks are being formed therefore contact must be avoided with fresh curbs to avoid damage when placing the aggregate.

Movement of the material from the dump site to a desired location such as an edge drain, a gabion basket or a sidewalk bed, is inefficient as a portion of the material is unavoidably wasted in transit from the dump site to the location where the material is to be placed. In addition to losing a portion of the material during movement, a portion of the material is lost due to the difficulty of retrieving all of the material initially dumped.

Dumping a large quantity of material and manually moving the material in discrete quantities is slow, tedious and expensive as the laborers must move the material with tools such as shovels to the desired location. Material can be placed perhaps more efficiently by a machine such as a front end loader but with limited ability for portioning the material and precisely placing the material.

Construction projects involving the placement of material also frequently involve positioning the material into a desired shape such as a road curb or a grade for a sidewalk, which can be accomplished manually or mechanically. The methods for positioning the material cannot, however, be accomplished simultaneously with the placement of the material in discrete quantities. Additionally, as mentioned above, road curbs are frequently in an uncured state when a sidewalk grade is prepared which provides an obstacle to grading the aggregate placed as a bed for the sidewalk.

From the foregoing, it will be appreciated that what is needed in the art are apparatus and methods for rapidly, efficiently, and economically placing discrete quantities of material at a desired location. Apparatus and methods are also needed for the simultaneous placement of discrete quantities of materials and positioning of the material.

BRIEF SUMMARY AND OBJECTS OF THE INVENTION

It is an object of this invention to increase the rate, increase the efficiency and decrease the cost of placing discrete quantities of materials at a desired location.

It is also an object of this invention to simultaneously place and position discrete quantities of materials.

To achieve the foregoing objects, and in accordance with the invention as embodied and broadly described herein it is a feature of this invention to have a powered apparatus with a frame supported on four wheels capable of receiving a large amount of material, metering the material and transferring the metered material to a side of the apparatus for precise placement at a desired location. The apparatus has a hopper mounted on the frame for receiving a large quantity of material. The hopper receives material from a dump truck which can be coupled to the apparatus. A metering means within the hopper meters the material into discrete quantities. The metering means is preferably a receiving conveyor comprising two receiving conveyor belt systems. The metering means can also be a sliding door at the bottom of the hopper. The metered material is transferred by the metering means to a cross conveyor attached to the frame and positioned perpendicularly to the longitudinal axis of the apparatus. The cross conveyor extends beyond the sides of the apparatus and is reversible to transfer the metered material to either side of the apparatus. The cross conveyor has a cross conveyor longitudinal movement system for gliding the cross conveyor on the longitudinal axis of the cross conveyor enabling one end of the cross conveyor to extend farther from the side of the apparatus.

The cross conveyor transfers the metered material to a side telescoping boom conveyor pivotally attached to the cross conveyor. The side telescoping boom conveyor transports the metered material and precisely places the metered material adjacent to the apparatus at a desired location. A material director is preferably attached to the end of the side telescoping boom placing the metered material. The material director can be angled into the flow of the metered material to more accurately place the metered material.

Attached at the other end of the cross conveyor is a material positioning attachment for precisely placing the metered material and simultaneously positioning the placed material into a desirable configuration. The material positioning attachment is laterally extendable and retractable and can be raised, lowered, and pivoted.

The material positioning attachment has several embodiments. One embodiment is a material grading attachment having a grading box. Metered material can be received in the grading box and graded. Another embodiment is a material shaping attachment having a motorized wheel with a rod eccentrically and pivotally attached to push a ram into a slip form. The material shaping attachment also has a metered material hopper whereby the metered material is collected and released in synchronization with the movement of the ram. The metered material hopper releases the metered material through a means for sequentially advancing an amount of material which is actuated by the exit of the ram from the slip form. The material is released in front of the ram and then compacted in the slip form.

It is an advantage of the methods and apparatus of this invention that the apparatus can receive a large quantity of material, meter the material, and transfer the metered material to a side of the apparatus for precise placement at a desired location thereby increasing the rate, increasing the efficiency and decreasing the cost of placing discrete quantities of materials at a desired location.

It is also an advantage of the methods and apparatus of this invention that the apparatus can simultaneously place and position discrete quantities of metered materials at a desired location.

Additional objects, features and advantages of the invention will be set forth in the description which follows, and in part will be obvious from the description, or may be learned by the practice of the invention. The objects, features and advantages of the invention may be realized and obtained by means of the instruments and combinations particularly pointed out in the appended claims.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
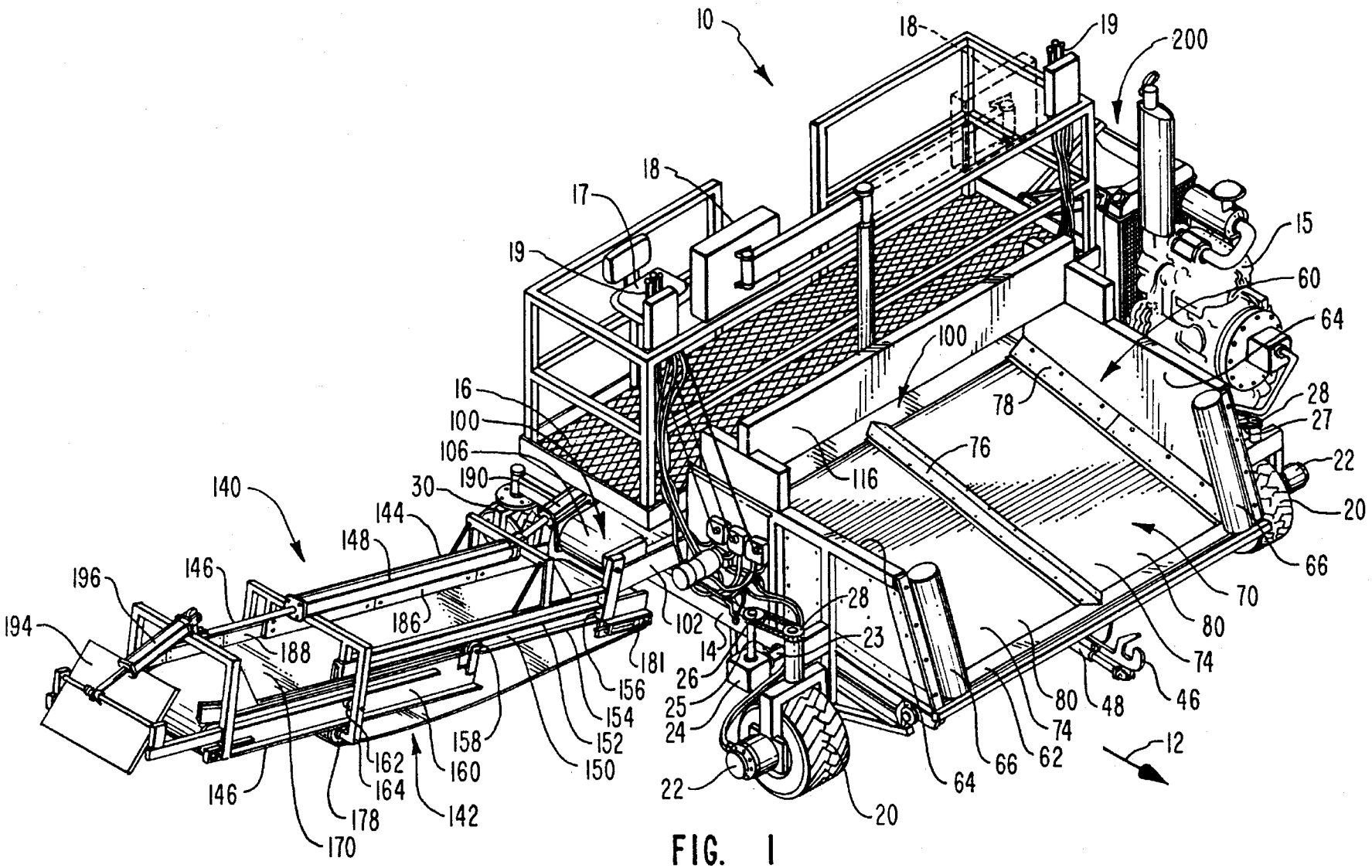
FIG. 1 is an isometric view showing the apparatus in accordance with the invention.

In FIG. 1 there is shown in isometric view a preferred embodiment of the present invention utilized for efficient and accurate placement of discrete quantities of materials adjacent to the apparatus 10 at a desired location as the apparatus 10 is advanced forward. The direction of advance of the apparatus 10 is indicated by the arrow 12, such that references to the front end, the rear end or sides of the apparatus 10 are in reference to the direction of travel. The longitudinal axis of the apparatus is in the same direction as arrow 12.

The apparatus 10 is capable of receiving a large amount of material, metering the material into a discrete quantity and transferring the metered material to a side of the apparatus for precise placement at a desired location. The material can be placed at a variable rate but it is most preferably placed at a uniform rate. The apparatus can also position the placed material by grading the material or shaping the material into a curb, a curb and gutter or other similar structures.

The major components of the apparatus are a support frame 14, a hopper 60, a receiving conveyor 70, a cross conveyor 100, a cross conveyor longitudinal movement system 120, a side telescoping boom conveyor 140, a material grading attachment 200 and a material shaping attachment 310.

A large quantity of material 40 is received by the hopper 60 and metered into discrete quantities by the receiving conveyor 70. The receiving conveyor 70 transfers the metered material to cross conveyor 100. The cross conveyor 100 extends beyond the sides of the apparatus and is reversible to transfer the metered material to either side of the apparatus 10. At one end of the cross conveyor 100 is a side telescoping boom conveyor 140 pivotally attached to the cross conveyor 100 and positioned to receive the metered material 40. The side telescoping boom conveyor 140 transports the metered material 40 from the side of the apparatus and accurately places the material at a desired location.

The cross conveyor can move along its longitudinal axis by the cross conveyor longitudinal movement system 120, thereby further extending the side telescoping boom conveyor 140 or an interchangeable material positioning attachment positioned at the other end of the cross conveyor 100. One embodiment of the material positioning attachment is the material grading attachment 200, whereby the metered material is simultaneously placed and graded. Another embodiment of the material positioning attachment is the material shaping attachment 310, whereby the metered material is simultaneously placed and shaped into structures such as a curb or a curb and gutter.

The apparatus 10 has a support frame 14 with sufficient strength to support the components attached to the support frame 14. An engine 15 is mounted on the support frame 14 to provide the necessary power for all the mechanized components of the apparatus 10. Power is supplied from the engine 15 throughout the apparatus to a plurality of hydraulic motors and hydraulic rams by a conventional hydraulic system. An operating platform 16 is positioned on the support frame 14 for an operator to control the apparatus 10. A seat 17 is removably mounted on the operating platform 16. The hydraulic system is operated through a control system comprising a pivotable control panel 18 and side attachment control panels 19. Positioning the seat and the pivotable control panel 18 on the side of the apparatus corresponding to the movement of the material enables an operator to conveniently operate the apparatus.

The apparatus 10 is advanced forward by two drive wheels 20 rotatably mounted on the support frame 14 at the front of the apparatus. Each drive wheel 20 has a hydraulic wheel drive motor 22 for driving each wheel, the wheel drive motors 22 are coupled directly to each wheel axle. In an alternative embodiment, the drive wheels can be rotated by a chain system utilized with each wheel drive motor.

The apparatus 10 is steered by powering a steering system coupled to the drive wheels 20 for synchronized turning of the drive wheels 20. The steering system is powered by a steering motor (not shown) which rotates a connecting shaft 23 by a chain system (not shown). A right angle gear box 24 is attached at each end of the connecting shaft 23 to translate the rotation to a vertical shaft 25. A vertical shaft sprocket 26 is fixedly attached to each vertical shaft 25. The vertical shaft sprockets 26 rotate as the vertical shafts 25 rotate, thereby moving a steering chain 27 which engages each vertical shaft sprocket 26 and a drive wheel steering sprocket 28 mounted on each drive wheel 20. As each steering chain 27 moves, the drive wheel steering sprockets 28 are rotated thereby turning the drive wheels 20 in synchronization to steer the apparatus 10. Alternatively, each drive wheel 20 can be turned independently by a motor and chain system. Two crazy wheels 30 are rotatably mounted on the support frame 14 at the rear of the apparatus 10.

Figure 2:
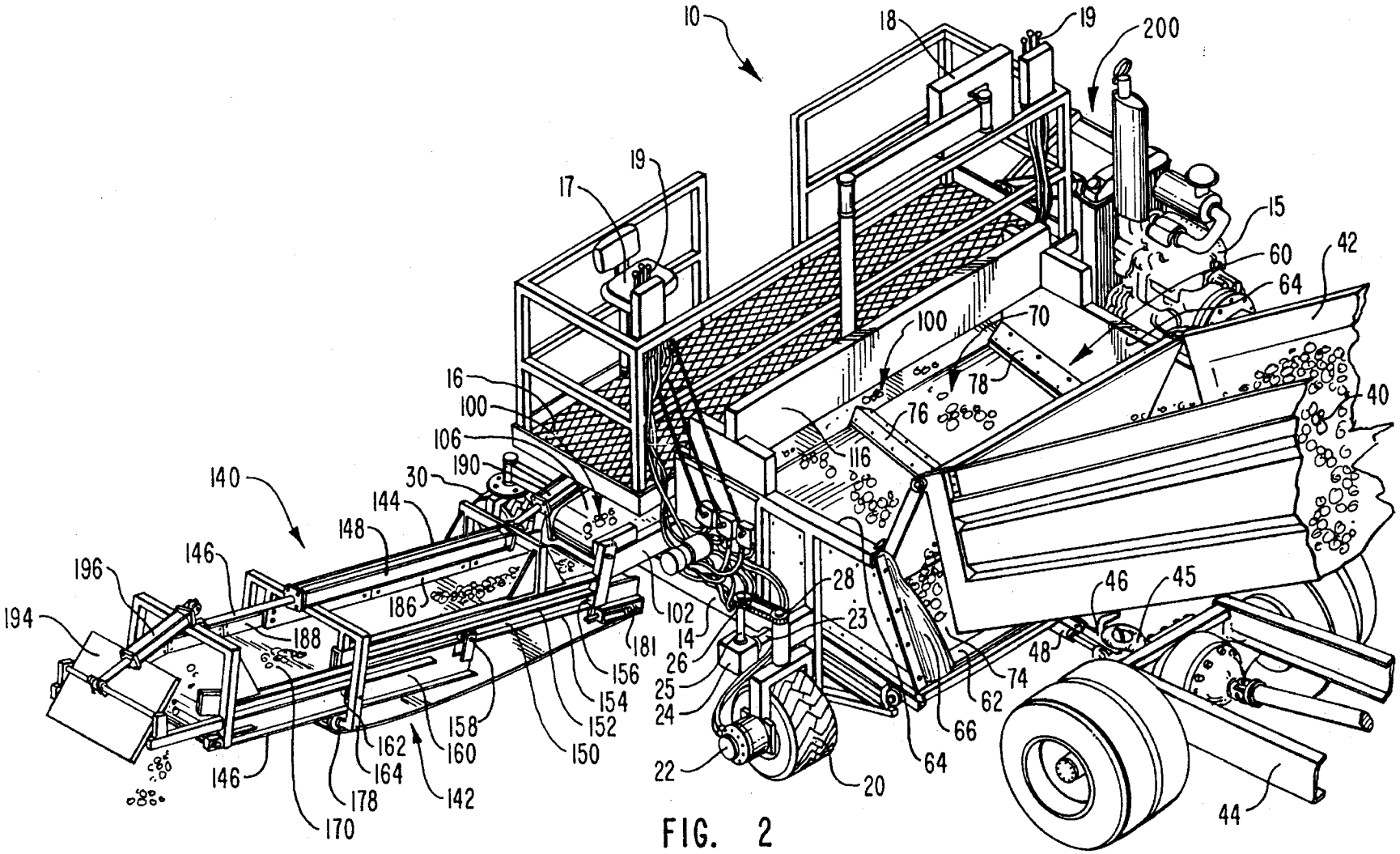
FIG. 2 is an isometric view showing the rear end of a dump truck coupled to the front of the apparatus.

Referring to FIG. 2, material 40 contained within a bed 42 of a dump truck 44 is transferred to the apparatus 10 by coupling the apparatus 10 to the dump truck 44 and raising the bed 42 of the dump truck 44. The rear end of the dump truck 44 is coupled to the front end of the apparatus 10 by engaging a connecting hook 45 attached at the rear of the dump truck 44 with a receiver hitch 46 attached at the front of the apparatus.

The receiver hitch 46 is attached to support frame 14 of the apparatus 10 and can be extended, retracted and pivoted. The range of motion permitted by extending, retracting and pivoting the receiver hitch 46 enables the receiver hitch to couple with any variety of connecting hook 44 configurations and a variety of sizes and types of dump trucks. The receiver hitch 46 is extended and retracted by a hydraulic ram 48 and attached at one end to the support frame 14 and at the other end to the receiver hitch 46. The receiver hitch is pivoted by a second hydraulic ram (not shown) and attached at one end to the support frame 14 and at the other end to the receiver hitch 46. In may also be desirable to attach receiving rollers at the front of the apparatus to receive the rear wheels of the dump truck 44.

After the rear end of the dump truck 44 is coupled to the front end of the apparatus 10 by engaging the connecting hook 44 of the dump truck 44 with a receiver hitch 46 of the apparatus 10, the bed 42 of the dump truck can be raised to transfer the material 40 to the apparatus 10. The apparatus 10 can be advanced after receiving the material. The apparatus 10 can be advanced by setting the dump truck 44 into neutral and utilizing the drive wheels 20 and 20, powered by engine 15 to push the dump truck 44. At speeds above one mile per hour it is preferable to set the apparatus 10 in neutral and allow the dump truck 44 to pull the apparatus 10.

The apparatus 10 has a hopper shown generally at 60 fixedly attached to the support frame 14 for receiving the material 40 from the bed 42 of the dump truck 44. The hopper 60 has a lip 62 at the front of the hopper 60 and sidewalls 64. The hopper 60 is of sufficient width to receive the discharge end of the bed 42 of the dump truck 44 and the lip 62 is angled to engage the discharge end when the bed 42 is raised to transfer the material 40. Flexible hopper flaps 66 are attached to each respective side wall 64 of the hopper. The hopper flaps 66 engage the sides of the dump truck as the dump truck transfers the material 40 to the hopper 60 and assists in retaining the transferred material in the hopper 60.

The lip 62 and the sidewalls 64 of the hopper 60 are lined with a heavy layer of plastic, preferably ultra-high-molecular-weight polyethylene, also known as UHMW. UHMW has high wear resistance to protect the hopper 60, a low coefficient of friction and it dampens the sound of the material impacting the hopper. The ultra-high-molecular-weight polyethylene can also be impregnated with petroleum products to further reduce the coefficient of friction throughout its use.

A means for metering the material is positioned at the bottom of the hopper 60 to support the material received by the hopper and to advance discrete quantities of the material 40 within the apparatus 10. The metering means in the preferred embodiment is a receiving conveyer 70 mounted on the support frame in an inclined position 14 with both the high end and the low end of the receiving conveyor 70 extending beyond the hopper 60. In addition to supporting and transporting the material received by the hopper, the receiving conveyor 70 can vary the flow rate of the material from the hopper 60.

The preferred embodiment of the receiving conveyor 70 has a receiving conveyor frame (not shown) supporting two receiving conveyor belt systems 74. The two receiving conveyor belt systems 74 are mounted adjacently on the receiving conveyor frame with a center deflector 76 positioned between the two receiving conveyor belt systems and a receiving conveyor side deflectors 78 positioned on each side of each receiving conveyor belt system facing the hopper sidewalls 64.

Figure 3:
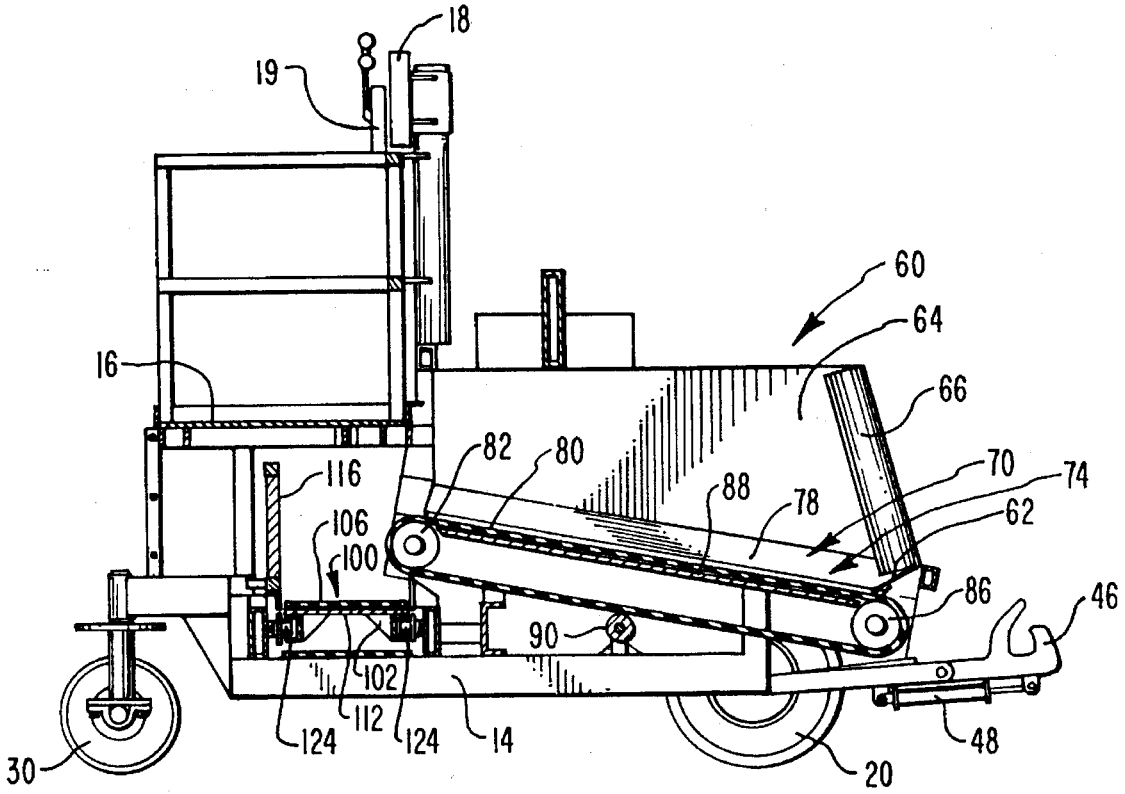
FIG. 3 is a cross-sectional view along the longitudinal axis of the apparatus in accordance with the invention.

Referring to FIG. 3, each conveyor belt system has a receiving conveyor belt 80 and each receiving conveyor belt is advanced by a drive roller 82, which is attached to the receiving conveyor frame and powered by hydraulic motor (not shown). An end roller 86 is attached to the receiving conveyor frame opposite each drive roller with slide pans 88 attached to the receiving conveyor frame between each drive roller 82 and each end roller 86. Belt rollers 90 are attached to the receiving conveyor frame and positioned to prevent each receiving conveyor belt from sagging. In the preferred embodiment, the drive rollers 82 are at the high end of the receiving conveyor 70. Conventional tracking means (not shown) are also utilized with each conveyer belt system.

The receiving conveyor belts 80 and the drive rollers 82 are preferably formed of rubber or a similar material to provide sufficient friction for advancing the belts by the rotation of the drive rollers. The other components of the receiving conveyer 70 are designed to minimize friction with the belts. A steel or plastic surface on the end rollers 86 and the slide pans 88 provides minimal friction and high durability. The preferable plastic surface on the slide pans 88 is UHMW. In the preferred embodiment, the receiving conveyor belts 80 are approximately four feet wide and can operate at varying speeds of up to approximately 100 feet/min.

The center deflector 76 is positioned along the top of the receiving conveyor 70 extending to or beyond the drive rollers 82 and end rollers 86 to prevent the material 40 from falling through the space between the conveyor belts 80 and interfering with the motion of the two conveyor belt systems 74. The center deflector 76 in the preferred embodiment has two sides joined at an angle less than 180° and is fixed on top of a support member (not shown) which extends between and slightly beyond the two conveyor belt systems and is continuous with the center deflector 76.

The two sides of the center deflector 76 extend beyond the support member toward the receiving conveyor belts and are offset a distance from the receiving conveyor belts to prevent the material from passing between the center deflector and the receiving conveyor belts, which is generally less than the diameter of the particles of the material 40. The receiving conveyor belts are preferably further protected by lining the center deflector with an UHMW outer layer and a rubber inner layer extending beyond the UHMW outer layer. The rubber inner layer further prevents the material 40 from entering through the top of the space between the two conveyor belt systems 74 as the rubber inner layer is in contact with the receiving conveyor belts or nearly in contact. The UHMW outer layer also protects the center deflector 76 from the material 40.

The center deflector can have many configurations and accomplish the same function as the preferred embodiment. The center deflector can, for example be flat and very close to the receiving conveyor belts or the center deflector can comprise more than two sides joined together at angles. The center deflector can also be attached within the apparatus in any manner. The center deflector can, for example, be positioned between and be slightly offset from the two receiving conveyor belts with multiple support members. Additionally, a center deflector can function without a support member by positioning the center deflector slightly offset from the receiving conveyor and attaching the ends of the center deflector within the apparatus.

The receiving conveyor side deflectors 78 extend downward from the hopper sidewalls 64 respectively toward the sides of the receiving conveyor belt systems abutting the hopper sidewalls 64. The receiving conveyor side deflectors 78 extend over the edges of the receiving conveyor belts and are offset from the receiving conveyor belts similar to the center deflector 76 to prevent the material from entering around the sides of the conveyor belt systems abutting the hopper walls 64 and interfering with the motion of the two conveyor belt systems 74. The receiving conveyor side deflectors 78 are preferably lined in a similar fashion to the center deflector 76 with an UHMW outer layer and a rubber inner layer extending beyond the UHMW outer layer to further prevent the material from entering around the sides of the two conveyor belt systems 74. The UHMW outer layer attached to the lip 62 of the hopper 60, the center deflector 76, and receiving conveyor side deflectors are preferably configured to provide a substantially continuous surface.

In an alternative embodiment of the present invention the receiving conveyor is a single conveyor belt system. Utilizing a single conveyor belt system decreases the potential for the material to interfere with the motion of the conveyor belt system but increases the difficulty of tracking the conveyor belt.

Figure 4:
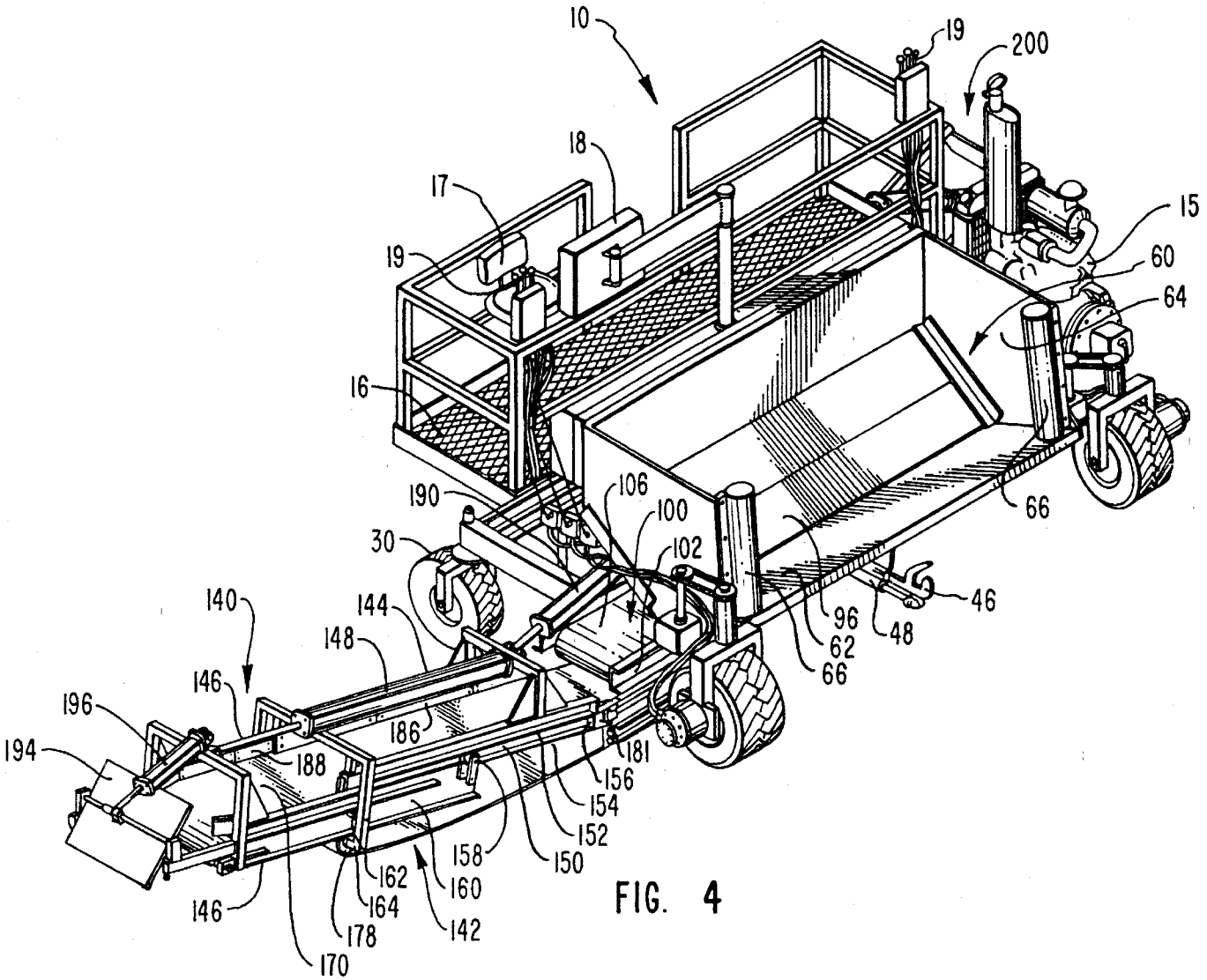
FIG. 4 is an isometric view showing an alternative embodiment of the apparatus in accordance with the invention.

Referring to FIG. 4, an alternative embodiment of the metering means is an opening located at the bottom of the hopper 60 defined by a sliding door 96 capable of incrementally closing and opening. The material flows through the opening by gravity and the flow rate of the material is metered by varying the width of the opening.

Figure 5:
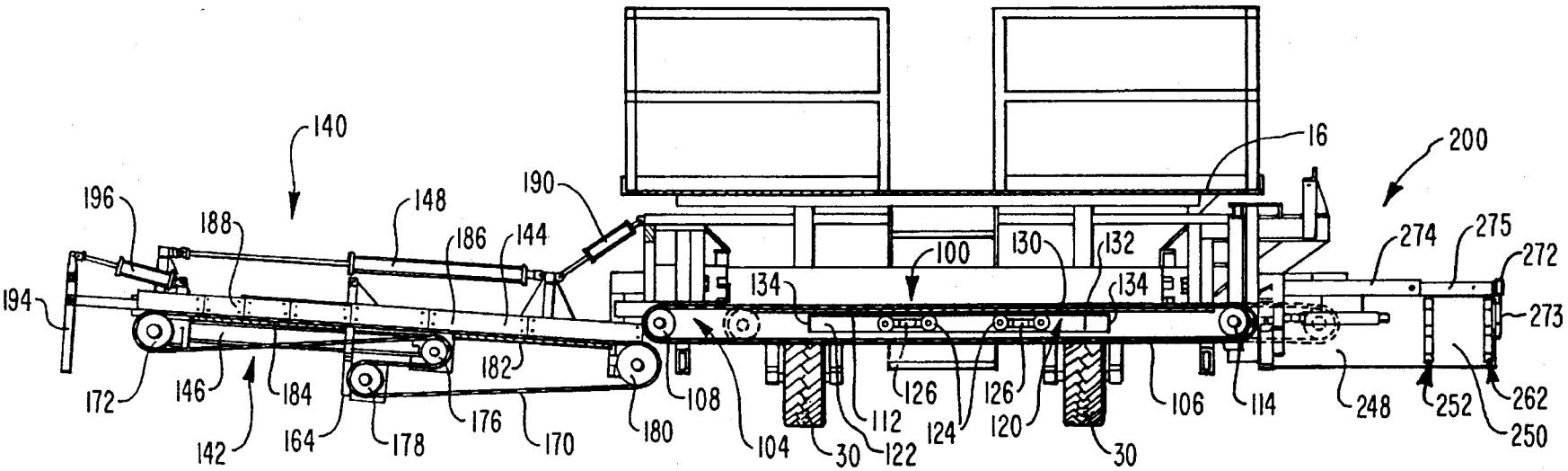
FIG. 5 is a cross-sectional view along the lateral axis of the apparatus in accordance with the invention.

Referring to FIG. 5, the metered material is received by a cross conveyor 100. The cross conveyor 100 is positioned perpendicular relative to the longitudinal axis of the apparatus 10 and is attached to the support frame 14 of the apparatus 10. The cross conveyor 100 comprises a cross conveyor frame 102 supporting a cross conveyor belt system 104. The cross conveyor belt system 104 has a cross conveyor belt 106, a drive roller 108, a hydraulic motor (not shown) for powering the drive roller 108, slide pan 112, and an end roller 114. The cross conveyor belt system is similar to the two receiving conveyor belt systems 74 except the drive roller 108 can also be a reversible drive roller and the end roller 114 can be an end roller or be powered by a motor to function as a drive roller or a reversible drive roller. It is preferable to use a reversible drive roller which rotates either clockwise or counterclockwise to enable the cross conveyor 100 to transport the metered material to either side of the apparatus. Conventional tracking means (not shown) are also utilized with the conveyer belt system.

The components of the cross conveyor belt system 104 are formed of the identical or comparable materials utilized for the corresponding components of the two receiving conveyor belt systems 74. The cross conveyor belt 106 and the drive roller 108 are designed to provide sufficient friction for advancing the belt 106 by the rotation of the drive roller 108. The other components of the cross conveyer 100 are designed to minimize friction with the belt 106. In the preferred embodiment, the belt cross conveyor belt 106 is approximately twenty inches wide and can operate at varying speeds of up to approximately 340 feet/min.

The cross conveyor 100 also has a cross conveyor deflecting side 116 attached to the cross conveyor frame 102 opposite the top end of the receiving conveyor 70 to deflect the metered material toward the cross conveyor belt as it is metered by the receiving conveyor 70 in discrete quantities. The cross conveyor deflecting side 116 extends over the edge of the belt 106 and is offset from the belt 106 to additionally prevent the metered material 40 from entering around the sides of the cross conveyor belt system 104 and interfering with the motion of the cross conveyor belt system 104. The cross conveyor deflecting side 116 is preferably UHMW or metal lined with UHMW.

The ability of the cross conveyor 100 to transport the metered material 40 to either side of the apparatus 10 is increased by utilizing a cross conveyor 100 which is movably attached to the support frame 14 of the apparatus 10, particularly a cross conveyor 100 which moves by extending or gliding on the longitudinal axis of the cross conveyor 100. A cross conveyor longitudinal movement system for gliding the cross conveyor on the longitudinal axis of the cross conveyor is shown generally at 120 in the preferred embodiment. Utilizing the cross conveyor longitudinal movement system 120 with the reversible cross conveyor 100 enables the metered material to be transferred to either side of the apparatus with an increased range of movement on the longitudinal axis of the cross conveyor. In addition to enabling the cross conveyor 100 to move, the cross conveyor longitudinal movement system 120 supports the cross conveyor 70.

Figure 6:
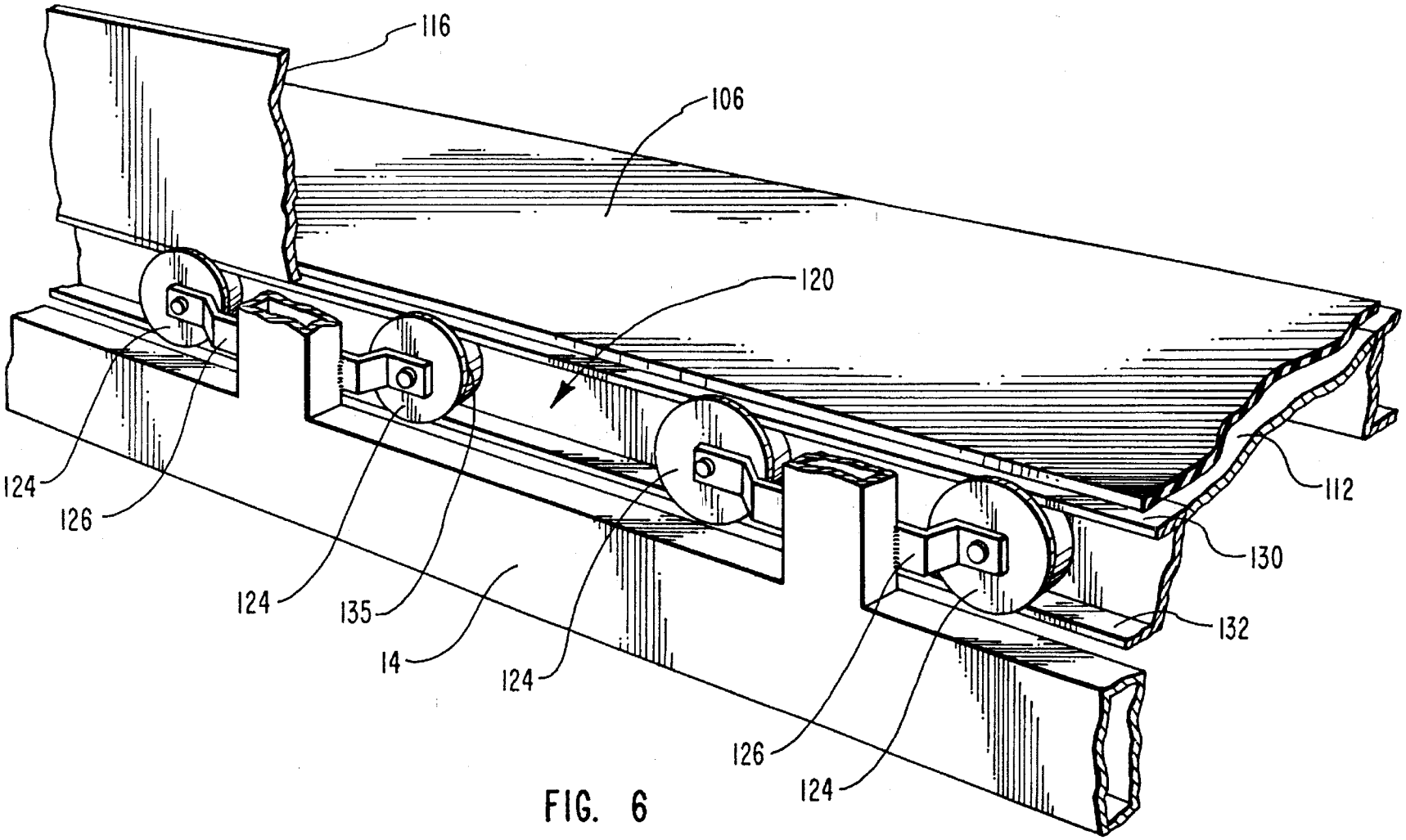
FIG. 6 is an enlarged break away view of the cross conveyor longitudinal movement system in accordance with the invention.

In FIG. 6, an enlarged break away view of the cross conveyor longitudinal movement system 120 is shown. The cross conveyor longitudinal movement system 120 comprises cross conveyor glide tracks 122 attached to each side of the cross conveyor frame 102, each cross conveyor glide track glidably engaging two pairs of glide wheels 124 rotatably attached to the support frame 14. In the preferred embodiment, each of the four pairs of glide wheels 124 are fixedly attached to a support brace 126 which is fixedly attached to the support frame 14 opposite one of the cross conveyor glide tracks 122. A hydraulic ram (not shown) is attached at one end of the support frame 14 and attached at the other end to the cross conveyor frame 102 for moving the cross conveyor 100.

The cross conveyor glide tracks 122 have a generally rectangular configuration. Each cross conveyor glide track has a top track 130, a bottom track 132 and two ends 134. Each wheel has sufficient width and diameter to glidably engage the top track and the bottom track. Additionally, each glide wheel 124 has an enlarged flange 135 having a diameter greater than the width between the top and bottom tracks of the corresponding cross conveyor glide track to better retain the cross conveyor glide tracks and the wheels in engagement, thereby supporting the cross conveyor 100. The rotatable wheels 124 are preferably formed of iron to provide sufficient support for the cross conveyor 100.

Actuating the hydraulic ram 128 causes the cross conveyor glide track 122 to glide across the rotatable wheels 124, which remain in a stationary position. Movement of the cross conveyor glide tracks 122 causes the cross conveyor 100 to move as it is attached to the cross conveyor glide tracks 122. The hydraulic ram 128 can move the cross conveyor 100 back and forth up to the a length equalling the difference between the length of the glide tracks 122 and the distance between the glide wheels 124 at opposite ends of one of the glide tracks 122. In the preferred embodiment, the cross conveyor 100 can slide up to two feet. In an alternative embodiment, the cross conveyor frame 102 can also be fixedly attached to the support frame 14 of the apparatus with at least one end of the cross conveyor 100 extending beyond a side of the apparatus 10.

A side telescoping boom conveyor 140 is pivotally attached at one end to the cross conveyor frame 102 and positioned to receive the metered material from the same end of the cross conveyor 100. The side telescoping boom conveyor 140 permits the metered material to be transported from the side of the apparatus and precisely placed adjacent to the apparatus in discrete quantities.

The side telescoping boom conveyor 140 has a telescoping conveyor belt system 142, a top frame section 144 pivotally attached to the cross conveyor frame 102, a bottom frame section 146 glidably engaging the top frame section 144, and a hydraulic ram 148 with one end of the hydraulic ram 148 attached to the top frame section 144 and the other end attached to the bottom frame section 146.

The top frame section 144 has top section glide tracks 150 fixedly attached on each external side of the top frame section 144. The top section glide tracks 150 have a generally rectangular configuration. Each top section glide track has a top track 152, a bottom track 154 and two ends 156. Glidably engaging each top section glide track is a glide wheel 158 rotatably attached to the bottom telescoping section 146 on each external side of the bottom frame section 146. The top section glide tracks 150 remains stationary relative to the glide wheels 158, which have sufficient width and diameter for glidably engaging the top track and the bottom track of each top section glide track. Additionally, each wheel has a flange rim side having a diameter greater than the width between the top and bottom tracks of the corresponding top section glide track to better retain the top frame section 144 and the glide wheels 158 in engagement, thereby supporting the bottom frame section 146.

The bottom frame section 146 has bottom section glide tracks 160 fixedly attached on each external side of the bottom frame section. Each bottom section glide track is positioned in a glidable engagement above a glide 162 rotatably attached to an end bracket 164 attached around the end of the top frame section 144 engaging the bottom frame section 146. The glide wheels 162 remain stationary relative to the movement of the bottom section glide tracks 160 across the glide wheels 162. The glide wheels 162 have sufficient width for glidably engaging the bottom section glide tracks 160 and to enable a flange rim side of each wheel to extend beyond the bottom section glide tracks to better retain the bottom section glide tracks and the wheels in engagement, thereby supporting the bottom frame section 146.

Actuating the hydraulic ram 148 extends or retracts the bottom frame section 146 across the top frame section 144 in a glidable engagement while the top frame section remains stationary. The configuration of the top frame section 144 and the bottom frame section in the preferred embodiment enables the side telescoping boom conveyor 140 to vary in length from about six feet to about ten feet.

The telescoping conveyor belt system 142 comprises a conveyor belt 170 advanced by drive roller 172 which is attached to the bottom frame section 146 and powered by motor (not shown), bottom section tensioning roller 176 attached to the bottom frame section 146, top section tensioning roller 178 attached to the end bracket 164 attached around the end of the top frame section 144, top section end roller 180 attached to the top frame section 144. Conventional tracking means 181 are also utilized with the telescoping conveyer belt system 142.

The conveyor belt 170 is preferably wider than the conveyor belt 104 of the cross conveyor belt system 106 to better receive the metered material 40. It may also be useful to utilize a declining guide to aid in transferring the metered material from the cross conveyor belt system to the telescoping conveyor belt system. A declining guide can be attached to the end of the cross conveyor frame and positioned to guide the transfer of the metered material to the telescoping conveyor belt system.

The components of the telescoping conveyor belt system 142 are formed of the identical or comparable materials utilized for the corresponding components of the two receiving conveyor belt systems 74 and the cross conveyor belt system 104. The conveyor belt 170 and the drive roller 172 are designed to provide sufficient friction for advancing the belt by the rotation of the drive roller. The other components of the cross conveyer are designed to minimize friction with the conveyor belt. In the preferred embodiment, the belt is approximately two feet wide and operates at a rate of up to approximately 540 feet/min.

The conveyor belt 170 is supported by a top slide pan 182 and a bottom slide pan 184. The top slide pan 182 is attached at one end to the top frame section 144 with the other end of the top slide pan 182 in a slidable engagement on top of one end of the bottom slide pan 184. The other end of the bottom slide pan 182 is attached to the bottom frame section 146, whereby movement of the bottom frame section 146 slides the bottom slide pan 184 underneath the top slide pan 182. The top slide pan 182 and the bottom slide pan 184 are preferably lined with UHMW.

The top frame section 144 has top section side deflectors 186 extending from the sides of the top frame section 144 over the edges of the conveyor belt 170 and offset above the conveyor belt 170 along the top frame section 144 to prevent the metered material 40 from entering around the sides of the telescoping conveyor belt system 142 and interfering with the motion of the telescoping conveyor belt system 142. The top section side deflectors 186 are preferably made of UHMW.

The sides of the bottom slide pan 184 extend beyond the conveyor belt as the bottom frame section 146 is wider than the top frame section 144 in the preferred embodiment. A portion of the metered material is pushed off the sides of the conveyor belt as the metered material is moved by the conveyor belt. Bottom section side deflectors 188 extend from the sides of the bottom frame section 144 to protect the sides of the bottom frame section from the force of the metered material pushed off the conveyor belt. The bottom section side deflectors 188 are preferably made of UHMW.

Varying the length of the side telescoping boom conveyor 140 enhances the ability of the apparatus 10 to place metered material at a precise location adjacent to the apparatus 10. Additionally, the length of the side telescoping boom conveyor 140 can be varied while the conveyor belt 170 is rotating around the telescoping conveyor belt system 142 and transporting metered material from the cross conveyor and also while the apparatus is advancing. The ability to simultaneously vary the length of the side telescoping boom conveyor 140 and rotate the conveyor belt 170 around the telescoping conveyor belt system 142 while the apparatus advances permits the apparatus to be in continuous operation while accurately placing metered material adjacent to the apparatus, thereby more efficiently completing a project.

The side telescoping boom conveyor 140 is pivotally attached to the support frame 14. A hydraulic ram 190 is attached at one end to the support frame 14 and at the other end to the top frame section 144 for pivoting the side telescoping boom conveyor 140. Pivoting the side telescoping boom conveyor 140 permits an operator to operate the apparatus 10 at a different level relative to the area where the metered material 40 is to be placed. In addition to enabling the apparatus 10 to operably conform to the contour of the land, pivoting the side telescoping boom conveyor 140 also permits raising it in an upright position when the apparatus 10 is in transit.

A material director can be attached to the other end of the side telescoping boom conveyor 140 for directing the flow of the metered material adjacent to the apparatus 10 to more precisely place the metered material. In the preferred embodiment, the material director is a deflector plate 194 pivotally attached to the other end of the bottom frame section 140 and a hydraulic ram 196 is attached at one end to the deflector plate 194 and attached at the other end to the bottom frame section 146. The deflector plate 194 can be raised to allow the metered material to be freely expelled from the side telescoping boom conveyor or the deflector plate 194 can be angled into the flow of the metered material as the metered material exits the side telescoping boom conveyor 140 to more accurately place the metered material at a desired location adjacent to the apparatus.

In an alternative embodiment, the side telescoping boom conveyor can pivot from side to side. In another alternative embodiment, the side telescoping boom conveyor is a side boom conveyor pivotally attached to the cross conveyor frame with a belt system remaining at a fixed length. In an additional alternative embodiment, the side telescoping boom conveyor is a side telescoping conveyor fixedly attached to the cross conveyor frame with a belt system configured to vary in length. In yet another alternative embodiment, the side telescoping boom conveyor is a side conveyor fixedly attached to the cross conveyor frame with a belt system remaining at a fixed length. A deflector plate can be attached to any of these embodiments. The deflector plate can also be directly attached to the cross conveyor without the side telescoping boom conveyor.

It is within the scope of this invention to utilize conveyor belts systems having belts with any dimensions and operating at any speed. The conveyor belt systems can be designed to have equal output rates based on the width and the speed of the belts. The conveyor belt systems can also be designed to further meter the rate of output of the material to optimize the volume and rate of placement of the metered material. The conveyor belt systems can meter the material by designing and operating at least one conveyor belt system to deliver the material at a different rate than the material was received. One skilled in the art can design and operate each system to optimally deliver the material based on the intended use of the apparatus.

A material positioning attachment is attached at one end to the support frame 14 of the apparatus 10 and configured to receive the metered material from the end of the cross conveyor 100 opposite the end supporting the side telescoping boom conveyor 140 and position the metered material as the metered material is placed adjacent to the apparatus. The embodiments of the material positioning attachment are able to place metered material at a desired location and to position the metered material in a desirable configuration such as a flat grade or a curb.

Figure 7:
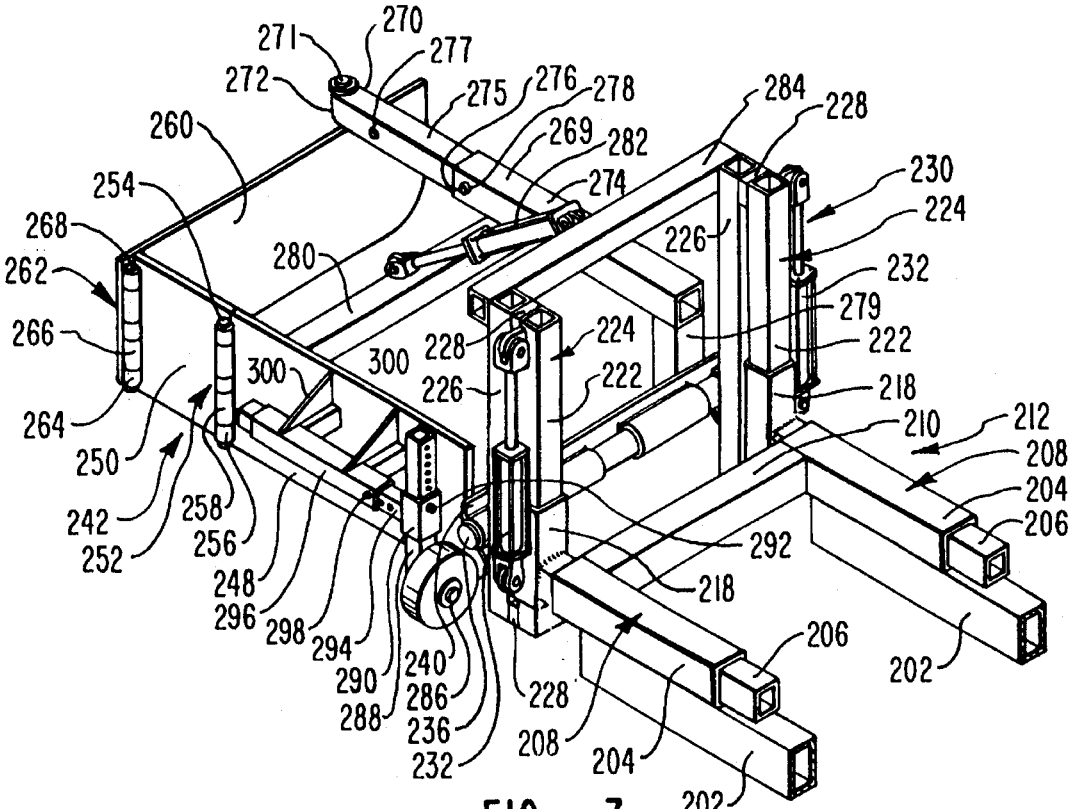
FIG. 7 is an enlarged isometric view showing a material grading attachment of the apparatus in accordance with the invention.
Figure 8:
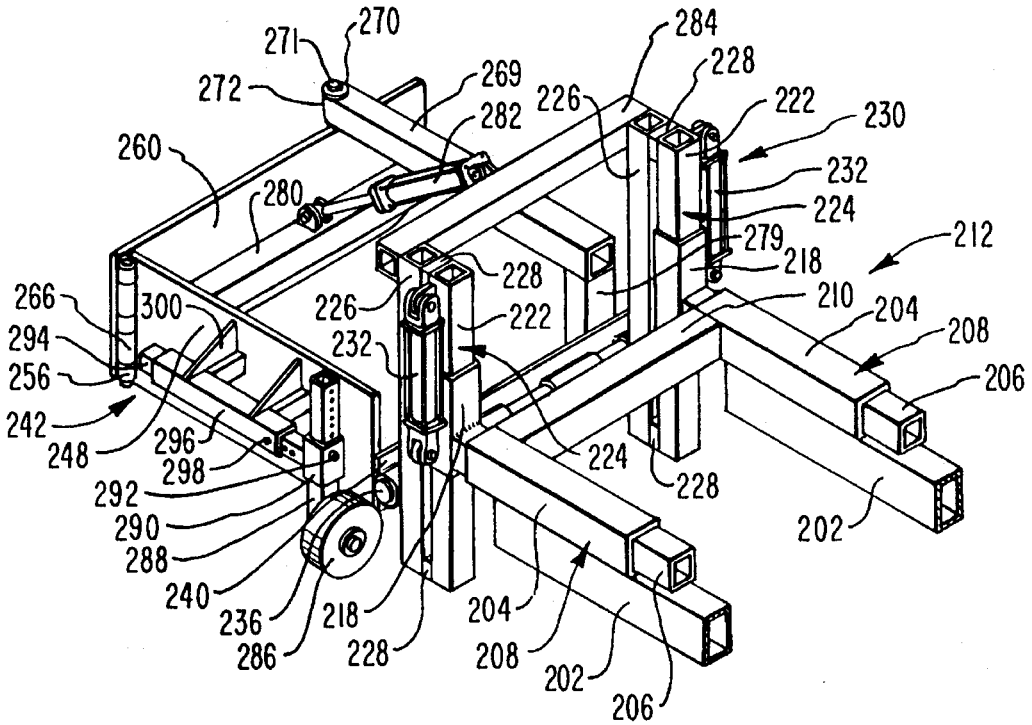
FIG. 8 is an enlarged isometric view showing a lowered material grading attachment without a back plate extension in accordance with the invention.

Referring to FIGS. 7 and 8, one embodiment of the material positioning attachment is a material grading attachment as shown generally at 200. The preferred embodiment of the material grading attachment 200 can be laterally extended, laterally retracted, raised, lowered and pivoted.

Lateral movement support members 202 attached to the support frame 14 provide support for the material grading attachment 200. An outer lateral telescoping tube 204 is fixedly attached above each lateral movement support member. Telescoping within each outer lateral telescoping tube in a slidable engagement with the outer lateral telescoping tube is an inner lateral telescoping tube 206 forming a lateral telescoping tube shown generally at 208.

A lateral movement connecting member 210 positioned below the end of the cross conveyor connects the outer lateral telescoping tubes 204 together to form a lateral movement support frame 212 with the lateral movement support members 202. The material grading attachment 200 can laterally extend or retract by actuating a hydraulic ram (not shown) attached at one end to the lateral movement connecting member 210 and attached at the other end of the hydraulic ram to the frame of the apparatus or to a member fixedly attached to the frame of the apparatus.

An outer vertical telescoping tube 218 is fixedly attached to an end of each inner lateral telescoping tube 206. Telescoping within each outer vertical telescoping tube in a slidable engagement with the outer vertical telescoping tube is an inner vertical telescoping tube 222 forming a vertical telescoping tube as shown generally at 224. Vertical movement frame bars 226 are fixedly offset from the inner vertical telescoping tubes 222 by pairs of spacers 228 to form a vertical movement support frame 230. The material grading attachment 200 can raised and lowered by actuating hydraulic rams 232, each hydraulic ram being attached at one end to an outer vertical telescoping tube 218 and attached at the other end to an inner vertical telescoping tube 222.

An attachment hinge 236 is removably attached to the vertical movement support frame 230 and to an inner side plate 240 of the grading box shown generally at 242. More particularly, the attachment hinge 236 is removably attached to the vertical movement support frame 230 at the vertical movement frame bars 226.

The inner side plate 240 is fixedly attached along a side bar (not shown). The side bar is fixedly attached perpendicularly to a back plate 248 of the grading box 242. A back plate extension 250 is removably connected at one end to the back plate by a first joint shown generally at 252. The first joint 252 has a hinge configuration with a first pin 254 inserted into a hole formed by two mated knuckles. One knuckle mate 256 being fixedly attached to an end of the back plate 248 and the other knuckle mate 258 being fixedly attached to an end of the back plate extension 250. The other end of the back plate extension 250 is removably connected to an outer side plate 260 by a second joint shown generally at 262. The second joint has a similar configuration as the first joint with one knuckle mate 264 being fixedly attached to the other end of the back plate extension 250 and the other knuckle mate 266 being fixedly attached to an end of the outer side plate 260 with a second pin 268 inserted into a hole formed by the two mated knuckles. As shown in FIG. 8, the length of the back of the grading box 242 can be decreased by removing the first and second pins to remove the back plate extension 250, joining the back plate knuckle mate 256 with the side plate knuckle mate 266 and inserting one of the pins.

The outer side plate 260 is removably connected to a telescoping front support bar 269 by a third joint 270. The third joint has a third pin 271 extending through a receiving end 272 of the telescoping front support bar 269 and a receiver 273 attached to the side plate 254. The telescoping front support bar 269 has an outer telescoping front support bar 274, an inner telescoping front support bar 275 and a locking pin 276 inserted though a bore in both the inner and outer telescoping front support bars for maintaining the telescoping front support bar 269 at a desired length. The inner telescoping front support bar 275 has two spaced bores 277 and 278 for receiving the locking pin. The spacing of the spaced bores 277 and 278 corresponds to the length of the back plate extension 248 whereby the telescoping front support bar 269 can be adjusted depending on the length of the back of the grading box 242. The other end of the telescoping front support bar 269 is connected to the side bar 246 by a riser 279 fixedly attached at one end to the telescoping front support bar 269 and fixedly attached at the other end to the side bar 246.

A center support member 280 fixedly attached at one end to the telescoping front support bar 269 and fixedly attached at the other end to the back plate 248 provides further support to the grading box 242 and also an attachment location for one end of a hydraulic ram 282 for pivoting the material grading attachment 200. The other end of the hydraulic ram 282 is attached to an anchoring member 284 with one end fixedly attached to one of the vertical movement frame bars 226 and the other end fixedly attached to the other vertical movement frame bar 226.

The grading box 242 can receive metered material from the end of the cross conveyor through the open top of the grading box 242 and grade the metered material. The grading box 242 can also pass over material through the open front of the grading box 242 and then grade the material.

The grading box 242 width can be varied between at least two positions through the use of the back plate extension 250. The preferred back plate extension 250 length is two feet although back plate extensions with any length can be utilized. The grading box 242 width with the back plate extension 250 is approximately five feet and the width without the back plate extension 250 is approximately three feet. The five feet wide position is particularly useful for grading in preparation for forming a sidewalk. The three feet wide position is particularly useful for grading between a sidewalk and a road curb.

A guide wheel 286 is attached to the grading box 242 which is particularly useful when grading between a road curb and a sidewalk by setting the guide wheel 286 on the road curb to act as a guide. The guide wheel 286 is rotatably mounted on an inner vertical telescoping bored tube 288. An inner vertical telescoping bored tube 288 is locked into a vertical position within an outer vertical telescoping bored tube 290 by a vertical locking pin 292. The outer vertical telescoping bored tube 288 is fixedly attached to an inner lateral telescoping bored tube 294. An inner lateral telescoping bored tube 294 is locked into a lateral position within an outer lateral telescoping bored tube 296 by a lateral locking pin 298. The outer lateral telescoping bored tube 296 is fixedly attached to the back side of the back plate 248 by attachment bars 300.

Figure 9:
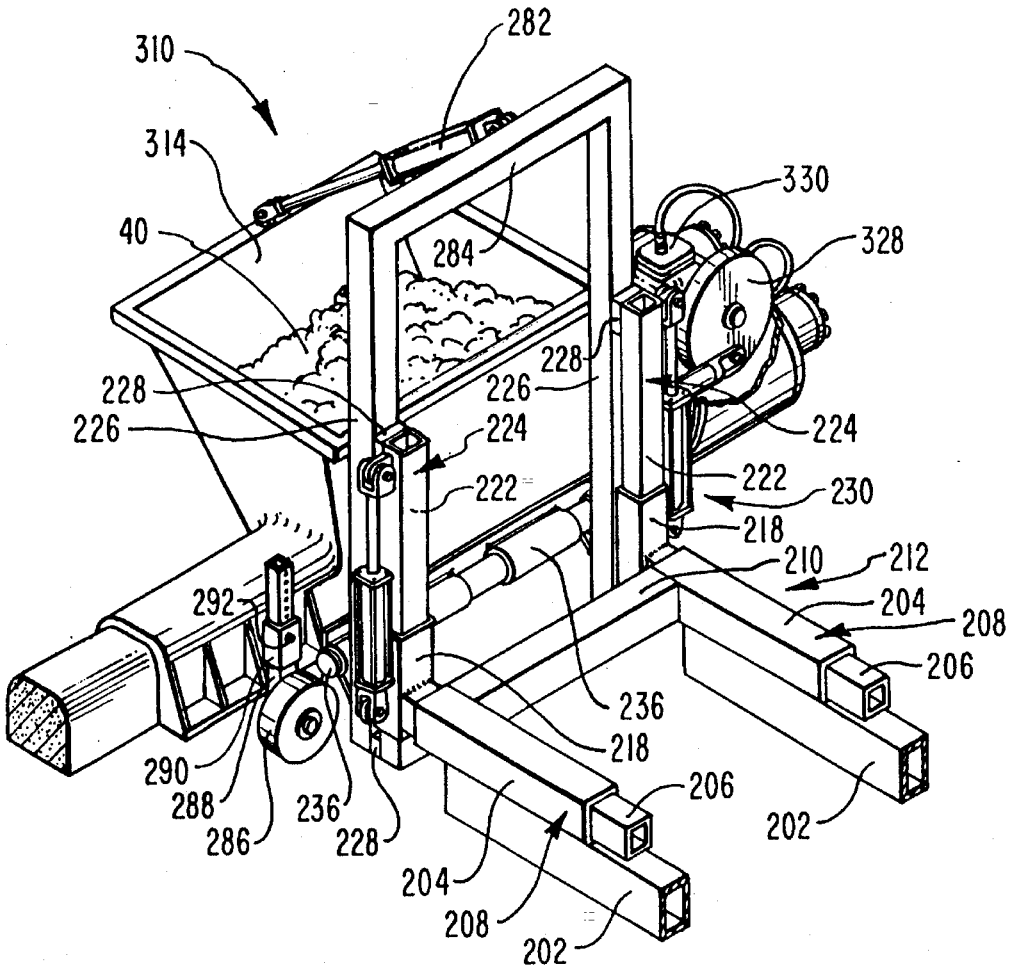
FIG. 9 is an enlarged isometric view showing a material shaping attachment of the apparatus in accordance with the invention.
Figure 10:
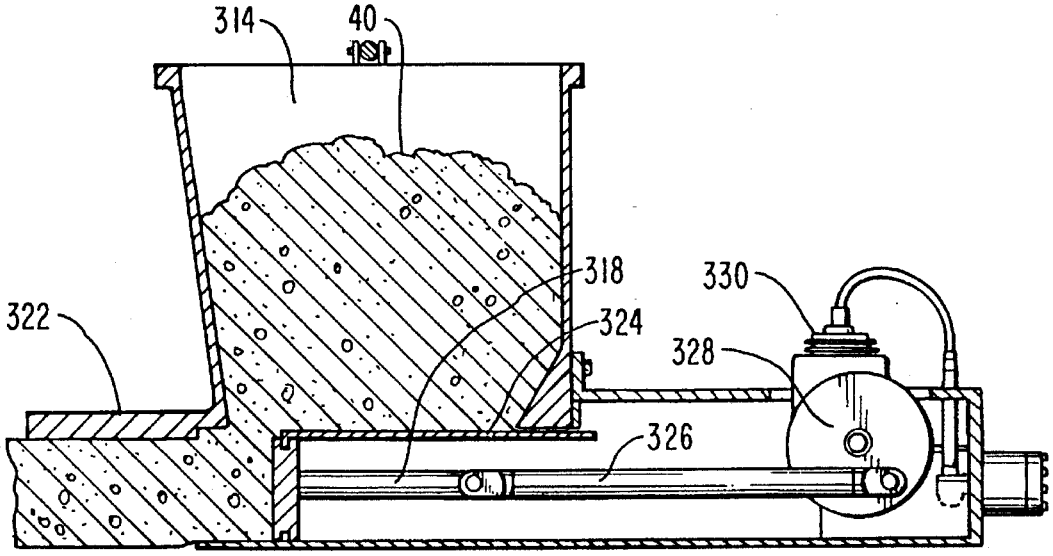
FIG. 10 is a cross-sectional view taken along the longitudinal axis of the material shaping attachment of the apparatus in accordance with the invention.

Referring to FIGS. 9 and 10, another embodiment of the material positioning attachment is a material shaping attachment as shown generally at 310. The material shaping attachment is particularly useful for forming structures such as a curb or a curb and gutter.

The preferred embodiment of the material shaping attachment 310 can be laterally extended, laterally retracted, raised, lowered, and pivoted in essentially the same manner as the material grading attachment 200 described above. Additionally, the components utilized to laterally extend, laterally retract, raise, lower, and pivot the material grading attachment 200 and the material shaping attachment 310 are essentially the same. The material shaping attachment 310 can also be interchanged with the material grading attachment 200 by disconnecting the attachment hinge 236.

In the preferred embodiment, the material shaping attachment 310 has a metered material hopper 314 which is removably attached to the attachment hinge 236. The attachment hinge enables the material shaping attachment to pivot to place the shaped material as desired. The material shaping attachment 310 is pivoted by hydraulic ram 282 attached at one end to anchoring member 284 and attached at the other end to the metered material hopper 314. The material shaping attachment 310 may also have a shaping attachment frame to offset the metered material hopper 314 from the attachment hinge 236. The hopper 314 may also be fixedly mounted to the either the vertical movement support frame 230 or directly to the support frame 14.

The metered material hopper 314 is positioned to receive material such as concrete from an end of the cross conveyor to collect the metered material. The metered material 40 is collected within the metered material hopper 314 and released from the metered material hopper 314 by a means for synchronizing the flow of material with the position of a ram 318 in a slip form 322. The synchronizing means 324 being positioned at the bottom of the hopper 314 and being actuated by the ram 318 to sequentially open and close to permit the metered material to flow by gravity in synchronization with the position of the ram 318, whereby a discrete quantity of the metered material is placed in front of the ram 318 for compaction in the slip form 322.

The ram 318 compacts the metered material 40 into the slip form 322 by the movement of a rod 326 pivotally attached at one end to the ram 318 and pivotally attached at the other end to a wheel 328. The wheel 328 being powered by a hydraulic motor 330. The rod 326 is attached at an eccentric point on the wheel 328 to provide an upstroke and a downstroke of the rod 326 by the rotation of the wheel 328. As the ram 318 is pushed underneath the bottom of the metered material hopper 314, the synchronizing means 324 is closed by the ram 318. Closure of the synchronizing means 324 allows the metered material 40 to collect in the metered material hopper 314 while the ram 318 compacts the metered material in the slip form 322. As the ram 318 is pulled back exiting the slip form 322, the synchronizing means is opened whereby the metered material is placed in front of the ram 318 for the next compaction. The slip form 322 can have any configuration. The preferred slip form 322 configuration is for forming a road curb. The slip form for forming road curbs is preferably about four feet long. Alternatively, the slip form 322 can have a configuration for forming a curb and gutter.

After the dump truck 44 has been coupled to the apparatus 10, the entire quantity of material 40 contained in the bed 42 of the dump truck 44 can be distributed at a uniform rate by metering the material 40 into a discrete quantity and transferring the metered material 40 to a side of the apparatus 10 for precise placement at a desired location. The rate can also be varied by varying the speed of the belts of the conveyor belts systems and/or the speed of the apparatus 10.

The metered material 40 is received into the hopper 60 from the bed 42 of the dump truck 44 and metered into discrete quantities by the receiving conveyor 70. The receiving conveyor 70 transfer the metered material to cross conveyor 100, which then transfers the metered material 40 to either side of the apparatus 10. At one end of the cross conveyor 100 the metered material 40 can be precisely placed at a desired location and at the other end the metered material 40 can also be simultaneously positioned into a desired shape.

Uses involving the precise placement of material at a desired location include: the placement of top soil, the filling of gabion baskets, the bedding of water and sewer lines, the placement of aggregates around an under drain near a roadway, the placement of aggregates around an edge drain on the side of a roadway, the placement of aggregate as grading for a curb or gutter, the placement of riprap at the edge of a body of water and the placement of aggregate around a water or phone line. To precisely place material for such uses, the material is transferred from one end of the cross conveyor 100 to the side telescoping boom conveyor 140. The side telescoping boom conveyor 140 transports the metered material 40 and accurately places the metered material 40 at a desired location. A deflector plate 194 can also be utilized to more accurately place the metered material 40.

To simultaneously place the metered material 40 at a desired location and position the metered material 40, the metered material 40 is transferred by the cross conveyor 100 to a material positioning attachment positioned at the opposite end of the cross conveyor 100 from the side telescoping boom conveyor 140. The material positioning attachment has at least two embodiments, the material grading attachment 200 and the material shaping attachment 310. The two attachments can be interchanged at the attachment hinge 236. Utilizing the two attachments permits the formation of a curb, a graded bed of aggregates for a sidewalk and a graded parkway area between the curb and the sidewalk.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame, the hopper having a bottom;

means for metering discrete quantities of the material from the hopper and transferring the metered material while supporting the material in the hopper, the metering means being positioned at the bottom of the hopper and powered through the hydraulic system; and means for transferring the metered material received from the metering means to a side of the apparatus, the transferring means being attached to the support frame, being perpendicular relative to the longitudinal axis of the apparatus and being powered through the hydraulic system, whereby the metered material is precisely placed adjacent to the apparatus.

2. An apparatus as defined in claim 1, wherein the hopper has a lip and two sidewalls.

3. An apparatus as defined in claim 1, wherein the metering means comprises a receiving conveyor.

4. An apparatus as defined in claim 3, wherein the receiving conveyor is a receiving conveyor frame and at least one conveyor belt system.

5. An apparatus as defined in claim 1, wherein the metering means comprises a sliding door in the means for receiving material.

6. An apparatus as defined in claim 1, wherein the transferring means comprises a cross conveyor having a cross conveyor frame supporting a cross conveyor belt system.

7. An apparatus as defined in claim 6, wherein the cross conveyor belt system is reversible.

8. An apparatus as defined in claim 6, wherein the cross conveyor is extendable on the longitudinal axis of the cross conveyor.

9. An apparatus as defined in claim 1, further comprising a means for moving the transferring means on the longitudinal axis of the transferring means.

10. An apparatus as defined in claim 9, wherein the transferring means is a cross conveyor having a cross conveyor frame supporting a cross conveyor belt system and the moving means is a cross conveyor longitudinal movement system.

11. An apparatus as defined in claim 10, wherein the cross conveyor longitudinal movement system comprises:

a hydraulic ram attached at one end to the support frame and attached at the other end to the cross conveyor frame, the hydraulic ram being powered through the hydraulic system;

two cross conveyor glide tracks, each cross conveyor glide track being fixedly attached to each side of the cross conveyor frame; and four pairs of glide wheels rotatably attached to the support frame, two of the four pair of glide wheels glidably engaging each cross conveyor glide track, whereby actuation of the hydraulic ram causes the cross conveyor to move as the cross conveyor frame is fixedly attached to the cross conveyor glide tracks.

12. An apparatus as defined in claim 1, wherein the transferring means comprises a cross conveyor having a cross conveyor frame supporting a cross conveyor belt system, the cross conveyor frame being fixedly attached to the support frame and having at least one end of the cross conveyor extending beyond a side of the apparatus.

13. An apparatus as defined in claim 1, further comprising a means for transporting the metered material from the side of the apparatus and precisely placing the material adjacent to the apparatus, an end of the transporting means being positioned to receive the material from an end of the transferring means.

14. An apparatus as defined in claim 13, wherein the transporting means is pivotally attached to the transferring means and further comprises a means for pivoting the transporting means, the pivoting means being attached at one end to the support frame and at the other end to the transporting means.

15. An apparatus as defined in claim 13, wherein the transporting means can extend and retract in length.

16. An apparatus as defined in claim 13, wherein the transporting means comprises:

a top frame section attached at one end to the transferring means;

a bottom frame section glidably engaging the other end of the top frame section at one end of the bottom frame section;

a hydraulic ram attached at one end to the top frame section and attached at the other end to the bottom frame section; and a telescoping conveyor belt system mounted on the top frame section and the bottom frame section.

17. An apparatus as defined in claim 16, wherein the top frame section has a top section glide track attached on each external side of the top frame section in a glidable engagement with a glide wheel rotatably attached to the bottom frame section on each external side of the bottom frame section, and wherein the bottom frame section has a bottom section glide track fixedly attached on each external side of the bottom frame section in a glidable engagement above a glide wheel rotatably attached to an end bracket attached around the end of the top frame section glidably engaging the bottom frame section, whereby the bottom frame section is extendable or retractable across the top frame section in a glidable engagement while the top frame section remains stationary.

18. An apparatus as defined in claim 16, wherein the top frame section has a top slide pan attached at one end to the top frame section with the other end of the top slide pan in a slidable engagement on top of one end of a bottom slide pan having another end fixedly attached to the bottom frame section, whereby movement of the bottom frame section slides the bottom slide pan underneath the top slide pan.

19. An apparatus as defined in claim 16, wherein the telescoping conveyor belt system comprises:

a conveyor belt advanced by a drive roller attached to the bottom frame section and powered by a hydraulic motor through the hydraulic system;

a bottom section tensioning roller attached to the bottom frame section;

a top section tensioning roller attached to an end bracket attached around an end of the top frame section; and a top section end roller attached to the top frame section, whereby the belt is advanced around the top and bottom frame sections.

20. An apparatus as defined in claim 1, further comprising:

means for directing the flow of the material, the directing means being pivotally attached at an end of the transferring means to more precisely place the metered material; and means for pivoting the directing means, the pivoting means being attached at one end to the directing means and at the other end to the support frame.

21. An apparatus as defined in claim 13, further comprising:

means for directing the flow of the material, the directing means being pivotally attached at the other end of the transporting means to more precisely place the metered material; and means for pivoting the directing means, the pivoting means being attached at one end to the directing means and at the other end to the transporting means.

22. An apparatus as defined in claim 16, further comprising:

means for directing the flow of the material, the directing means being pivotally attached at the other end of the bottom frame section to more precisely place the metered material;

means for pivoting the directing means, the pivoting means being attached at one end to the directing means and at the other end to the bottom frame section.

23. An apparatus as defined in claim 1, further comprising a material positioning attachment attached to the support frame adjacent to the apparatus and being configured to receive the metered material from an end of the transferring means and to position the metered material.

24. An apparatus as defined in claim 23, wherein the material positioning attachment can be laterally extended, laterally retracted, raised, lowered, and pivoted.

25. An apparatus as defined in claim 23, wherein the material positioning attachment is a material grading attachment.

26. An apparatus as defined in claim 25, wherein the material grading attachment comprises a grading box.

27. An apparatus as defined in claim 23, wherein the material positioning attachment is a material shaping attachment.

28. An apparatus as defined in claim 27, wherein the material shaping attachment comprises:

a metered material hopper positioned to receive material from an end of the cross conveyor to collect the metered material;

a slip form positioned below the hopper to receive the metered material;

a ram positioned within the slip form to compact the material received into the slip form;

a rod pivotally attached at one end to the ram and pivotally attached at the other end at an eccentric point on a wheel, the wheel being rotated by a hydraulic through the hydraulic system; and a means for synchronizing the flow of the metered material collected within the metered material hopper with the position of the ram in the slip form, the synchronizing means being positioned at the bottom of the hopper and being actuated by the ram to sequentially open and close to permit the metered material to flow by gravity in synchronization with the position of the ram, whereby a discrete quantity of the metered material is placed in front of the ram for compaction in the slip form.

29. An apparatus as defined in claim 13, wherein the transporting means is attached to the support frame.

30. An apparatus as defined in claim 13, wherein the transporting means is attached to the transferring means.

31. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame, the hopper having a bottom;

a receiving conveyor for metering discrete quantities of the material from the hopper and transferring the metered material while supporting the material in the hopper, the receiving conveyor being positioned at the bottom of the hopper and powered through the hydraulic system; and a cross conveyor for transferring the metered material received from the receiving conveyor to a side of the apparatus, the cross conveyor being attached to the support frame, being perpendicular relative to the longitudinal axis of the apparatus and being powered through the hydraulic system, whereby the metered material is precisely placed adjacent to the apparatus.

32. An apparatus as defined in claim 31, further comprising a means for transporting the metered material from the side of the apparatus and precisely placing the material adjacent to the apparatus, an end of the transporting means being positioned to receive the material from an end of the cross conveyor.

33. An apparatus as defined in claim 31, further comprising a material positioning attachment attached to the support frame adjacent to the apparatus and being configured to receive the metered material from an end of the cross conveyor and to position the metered material.

34. An apparatus as defined in claim 29, wherein the cross conveyor is fixedly attached to the support frame.

35. An apparatus as defined in claim 29, wherein the cross conveyor is movably attached to the support frame.

36. An apparatus as defined in claim 30, wherein the transporting means is attached to the support frame.

37. An apparatus as defined in claim 30, wherein the transporting means is attached to the cross conveyor.

38. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame;

a receiving conveyor for metering discrete quantities of the material from the hopper and transferring the metered material, the receiving conveyor being fixedly attached to the hopper and powered through the hydraulic system;

a cross conveyor for transferring the metered material received from the receiving conveyor to a side of the apparatus, the cross conveyor being movably attached to the support frame, being perpendicular relative to the longitudinal axis of the apparatus and being powered through the hydraulic system, whereby the metered material is precisely placed adjacent to the apparatus; and a means for transporting the metered material from the side of the apparatus and precisely placing the material adjacent to the apparatus, an end of the transporting means being positioned to receive the material from an end of the cross conveyor and being attached to the cross conveyor.

39. An apparatus as defined in claim 38, wherein the transporting means comprises a side telescoping boom conveyor.

40. An apparatus as defined in claim 38, further comprising a material positioning attachment attached to the support frame adjacent to the apparatus and being configured to receive the metered material from an end of the cross conveyor and to position the metered material.

41. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame;

a receiving conveyor for metering discrete quantities of the material from the hopper and transferring the metered material, the receiving conveyor being fixedly attached to the hopper and powered through the hydraulic system;

a cross conveyor for transferring the metered material received from the receiving conveyor to a side of the apparatus, the cross conveyor being movably attached to the support frame, being perpendicular relative to the longitudinal axis of the apparatus and being powered through the hydraulic system; and a side telescoping boom conveyor for transporting the metered material from the side of the apparatus and precisely placing the material adjacent to the apparatus, an end of the side telescoping boom conveyor being positioned to receive the material from an end of the cross conveyor and being attached to the cross conveyor.

42. An apparatus as defined in claim 41, wherein the side telescoping boom conveyor comprises:

a top frame section attached at one end to the cross conveyor;

a bottom frame section glidably engaging the other end of the top frame section at one end of the bottom frame section;

a hydraulic ram attached at one end to the top frame section and attached at the other end to the bottom frame section; and a telescoping conveyor belt system mounted on the top frame section and the bottom frame section.

43. An apparatus as defined in claim 41, further comprising a material positioning attachment attached to the support frame adjacent to the apparatus and being configured to receive the metered material from an end of the cross conveyor and to position the metered material.

44. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame;

a receiving conveyor for metering discrete quantities of the material from the hopper and transferring the metered material, the receiving conveyor being fixedly attached to the hopper and powered through the hydraulic system; and a cross conveyor for transferring the metered material received from the receiving conveyor to a side of the apparatus, the cross conveyor being movably attached to the support frame, being perpendicular relative to the longitudinal axis of the apparatus and being powered through the hydraulic system;

a side telescoping boom conveyor for transporting the metered material from the side of the apparatus and precisely placing the material adjacent to the apparatus, an end of the side telescoping boom conveyor being positioned to receive the material from an end of the cross conveyor and being attached to the cross conveyor; and a material positioning attachment attached to the support frame adjacent to the apparatus and being configured to receive the metered material from an end of the cross conveyor and to position the metered material.

45. An apparatus as defined in claim 44, wherein the material positioning attachment is a material grading attachment.

46. An apparatus as defined in claim 44, wherein the material positioning attachment is a material shaping attachment.

47. A method for efficiently and precisely placing material adjacent to an apparatus, the method comprising the steps of:

providing an apparatus having an engine mounted on a support frame, a hydraulic system for supplying power from the engine throughout the apparatus, a control system for operating the apparatus, and four wheels rotatably mounted on the support frame, two of said wheels being powered through the hydraulic system to advance the apparatus forward and to steer the apparatus;

coupling a dump truck having a bed containing a large quantity of material to the apparatus;

transferring the material in the bed of the truck to a hopper mounted on the support frame of the apparatus;

advancing the apparatus;

metering the material in the hopper by a meter;

transferring the metered material from the meter to a cross conveyor;

transferring the metered material from the cross conveyor to the side of the apparatus; and placing the metered material at a precise location adjacent to the apparatus.

48. The method of claim 47, further comprising the step of positioning the metered material as the material is simultaneously placed at a precise location adjacent to the apparatus.

49. The method of claim 47, further comprising the step of grading the metered material as the material is simultaneously placed at a precise location adjacent to the apparatus.

50. The method of claim 47, further comprising the step of shaping the metered material as the material is simultaneously placed at a precise location adjacent to the apparatus.

51. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame, the hopper having a bottom;

means for metering discrete quantities of the material from the hopper and transferring the metered material while supporting the material in the hopper, the metering means being positioned at the bottom of the hopper and powered through the hydraulic system;

means for transferring the metered material received from the metering means to a side of the apparatus, the transferring means being attached to the support frame, being perpendicular relative to the longitudinal axis of the apparatus and being powered through the hydraulic system, whereby the metered material is precisely placed adjacent to the apparatus; and means for transporting the metered material from the side of the apparatus and precisely placing the material adjacent to the apparatus, an end of the transporting means being positioned to receive the material from an end of the transferring means.

52. An apparatus as defined in claim 51, further comprising a material positioning attachment being configured to receive the metered material from another end of the transferring means and to position the metered material.

53. An apparatus comprising:

a support frame;

an engine mounted on the support frame;

a hydraulic system for supplying power from the engine throughout the apparatus;

four wheels rotatably mounted on the support frame, two of said wheels being powered through the hydraulic system to advance the apparatus forward and to steer the apparatus;

a control system for operating the apparatus;

a hopper for receiving the material, the hopper being fixedly attached to and supported by the support frame, the hopper having a bottom;

means for metering discrete quantities of the material from the hopper and transferring the metered material while supporting the material in the hopper, the metering means being positioned at the bottom of the hopper and powered through the hydraulic system;

means for transferring the metered material received from the metering means to a side of the apparatus, the transferring means being attached to the support frame, being perpendicular relative to the longitudinal axis of the apparatus and being powered through the hydraulic system, whereby the metered material is precisely placed adjacent to the apparatus; and a material positioning attachment configured to receive the metered material from an end of the transferring means and to position the metered material.

54. An apparatus as defined in claim 53, further comprising a means for transporting the metered material from the side of the apparatus and precisely placing the material adjacent to the apparatus, an end of the transporting means being positioned to receive the material from another end of the transferring means.

55. An apparatus comprising:

a support frame;

a hydraulic system for supplying power from an engine throughout the apparatus;

at least two wheels rotatably mounted on the support frame;

a control system for operating the apparatus;

a hopper for receiving the material, the hopper being fixedly attached to and supported by the support frame, the hopper having a bottom;

means for metering discrete quantities of the material from the hopper and transferring the metered material while supporting the material in the hopper, the metering means being positioned at the bottom of the hopper and powered through the hydraulic system; and means for transferring the metered material received from the metering means to a side of the apparatus, the transferring means being attached to the support frame, being perpendicular relative to the longitudinal axis of the apparatus and being powered through the hydraulic system, whereby the metered material is precisely placed adjacent to the apparatus.

56. An apparatus as defined in claim 55, further comprising a means for transporting the metered material from the side of the apparatus and precisely placing the material adjacent to the apparatus, an end of the transporting means being positioned to receive the material from an end of the transferring means.

57. An apparatus as defined in claim 55, further comprising a material positioning attachment being configured to receive the metered material from an end of the transferring means and to position the metered material.

* * * * *

UNITED STATES PATENT AND TRADEMARK OFFICE

CERTIFICATE OF CORRECTION

PATENT NO. : 5,470,175
DATED : November 28, 1995
INVENTOR(S) : Darrel V. Jensen, et al It is certified that error appears in the above-indentified patent and that said Letters Patent is hereby corrected as shown below:

Col. 1, line 67, change "formed therefore contact" to --formed; therefore, contact--.

Col. 10, line 11, change "remains" to --remain--.

Col. 13, line 14, change "can raised" to --can be raised--.

Col. 15, line 3, delete first occurrence of "the".

Col. 15, line 12, change "being positioned" to --is positioned--.

Col. 15, lines 12-13, change "being actuated" to --is actuated--.

Col. 15, line 21, change "being powered" to --is powered--.

Signed and Sealed this

Twenty-ninth Day of April, 1997

Bruce Lehman

*Attest:*

BRUCE LEHMAN

*Attesting Officer*

*Commissioner of Patents and Trademarks*